US008298081B1

(12) United States Patent
Merritt et al.

(10) Patent No.: US 8,298,081 B1
(45) Date of Patent: Oct. 30, 2012

(54) GAMING SYSTEM, GAMING DEVICE AND METHOD FOR PROVIDING MULTIPLE DISPLAY EVENT INDICATORS

(75) Inventors: Brent Alan Merritt, Reno, NV (US); Cullen Patrick O'Day, Reno, NV (US); Cari L. Blomquist, Reno, NV (US); David James Stoveld, Reno, NV (US); Kevin Norman Taylor, Reno, NV (US); George Gordon Ridge, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 13/162,138

(22) Filed: Jun. 16, 2011

(51) Int. Cl.
*A63F 9/24* (2006.01)

(52) U.S. Cl. ..... 463/33; 463/32

(58) Field of Classification Search ..... 463/20–42
See application file for complete search history.

(56) References Cited

U.S. PATENT DOCUMENTS

| | | | |
|---|---|---|---|
| 1,978,395 | A | 4/1934 | Groetchen |
| 2,545,644 | A | 3/1951 | Benton et al. |
| 3,420,525 | A | 1/1969 | Waders |
| 3,642,287 | A | 2/1972 | Lally et al. |
| 3,708,219 | A | 1/1973 | Forlini et al. |
| 3,735,987 | A | 5/1973 | Ohki |
| 3,975,022 | A | 8/1976 | Figueroa |
| 4,326,351 | A | 4/1982 | Heywood et al. |
| 4,333,715 | A | 6/1982 | Brooks |
| 4,410,178 | A | 10/1983 | Partridge |
| 4,448,419 | A | 5/1984 | Telnaes |
| 4,517,558 | A | 5/1985 | Davids |
| 4,574,391 | A | 3/1986 | Morishima |
| 4,607,844 | A | 8/1986 | Fullerton |
| 4,621,814 | A | 11/1986 | Stepan et al. |
| 4,659,182 | A | 4/1987 | Aizawa |
| 4,695,053 | A | 9/1987 | Vazquez, Jr. et al. |
| 4,718,672 | A | 1/1988 | Okada |
| 4,732,386 | A | 3/1988 | Rayfiel |

(Continued)

FOREIGN PATENT DOCUMENTS

| | | |
|---|---|---|
| CA | CA 2 265 283 | 10/1926 |

(Continued)

OTHER PUBLICATIONS

"Is it real, or is it REELdepth?" Advertisement, Copyright 2008 to IGT (1 page).

*Primary Examiner* — Masud Ahmed
(74) *Attorney, Agent, or Firm* — Neal, Gerber & Eisenberg LLP

(57) ABSTRACT

In various embodiments, the gaming system, gaming device, and gaming method disclosed herein utilizes a single display device to display at least one event indicator which conveys information that is otherwise displayed over a plurality of display devices. In one embodiment, the gaming system employs a multiple layered display device, wherein at least one layer of the display device displays the play of the primary game and at least one layer of the display device displays one or more event indicators. Such event indicators indicate information regarding the play of a secondary game displayed on a secondary display device. Such a configuration alleviates the player from having to frequently look up at the secondary display to determine information regarding the play of the secondary game and then look back down to the primary display to view the play of the primary game.

13 Claims, 8 Drawing Sheets

U.S. PATENT DOCUMENTS

| | | | |
|---|---|---|---|
| 4,745,197 | A | 5/1988 | Eisenbarth et al. |
| 4,911,449 | A | 3/1990 | Dickinson et al. |
| 4,912,548 | A | 3/1990 | Shanker et al. |
| 4,978,129 | A | 12/1990 | Komeda et al. |
| 5,058,893 | A | 10/1991 | Bertram et al. |
| 5,086,354 | A | 2/1992 | Bass et al. |
| 5,113,272 | A | 5/1992 | Reamey |
| 5,132,839 | A | 7/1992 | Travis |
| 5,152,529 | A | 10/1992 | Okada |
| 5,319,491 | A | 6/1994 | Selbrede |
| 5,342,047 | A | 8/1994 | Heidel et al. |
| 5,364,100 | A | 11/1994 | Ludlow et al. |
| 5,375,830 | A | 12/1994 | Takemoto et al. |
| 5,376,587 | A | 12/1994 | Buchmann et al. |
| 5,393,057 | A | 2/1995 | Marnell, II |
| 5,393,061 | A | 2/1995 | Manship et al. |
| 5,395,111 | A | 3/1995 | Inoue |
| 5,449,173 | A | 9/1995 | Thomas et al. |
| 5,467,893 | A | 11/1995 | Landis, II et al. |
| 5,539,547 | A | 7/1996 | Ishii et al. |
| 5,560,603 | A | 10/1996 | Seelig et al. |
| 5,580,055 | A | 12/1996 | Hagiwara |
| 5,584,763 | A | 12/1996 | Kelly et al. |
| 5,584,764 | A | 12/1996 | Inoue |
| 5,585,821 | A | 12/1996 | Ishikura et al. |
| 5,589,980 | A | 12/1996 | Bass et al. |
| 5,609,524 | A | 3/1997 | Inoue |
| 5,647,798 | A | 7/1997 | Falciglia |
| 5,655,965 | A | 8/1997 | Takemoto et al. |
| 5,664,998 | A | 9/1997 | Seelig et al. |
| 5,722,891 | A | 3/1998 | Inoue |
| 5,725,428 | A | 3/1998 | Achmüller |
| 5,745,197 | A | 4/1998 | Leung et al. |
| 5,752,881 | A | 5/1998 | Inoue |
| 5,762,552 | A | 6/1998 | Vuong et al. |
| 5,764,317 | A | 6/1998 | Sadovnik et al. |
| 5,785,315 | A | 7/1998 | Eiteneer et al. |
| 5,788,573 | A | 8/1998 | Baerlocher et al. |
| 5,823,872 | A | 10/1998 | Prather et al. |
| 5,823,874 | A | 10/1998 | Adams et al. |
| D400,597 | S | 11/1998 | Hedrick et al. |
| 5,833,537 | A | 11/1998 | Barrie |
| D402,702 | S | 12/1998 | Seelig et al. |
| 5,848,932 | A | 12/1998 | Adams |
| 5,851,148 | A | 12/1998 | Brune et al. |
| 5,863,249 | A | 1/1999 | Inoue |
| D406,865 | S | 3/1999 | Heidel |
| 5,882,261 | A | 3/1999 | Adams |
| 5,908,381 | A | 6/1999 | Aznoian et al. |
| 5,910,046 | A | 6/1999 | Wada et al. |
| 5,911,418 | A | 6/1999 | Adams et al. |
| 5,923,307 | A | 7/1999 | Hogle, IV |
| 5,927,714 | A | 7/1999 | Kaplan |
| 5,947,820 | A | 9/1999 | Morro et al. |
| 5,951,397 | A | 9/1999 | Dickinson |
| 5,956,180 | A | 9/1999 | Bass et al. |
| 5,967,893 | A | 10/1999 | Lawrence et al. |
| 5,976,015 | A | 11/1999 | Seelig et al. |
| 5,980,384 | A | 11/1999 | Barrie |
| 5,984,782 | A | 11/1999 | Inoue |
| 5,997,401 | A | 12/1999 | Crawford |
| 6,001,016 | A | 12/1999 | Walker et al. |
| 6,004,207 | A | 12/1999 | Wilson, Jr. et al. |
| 6,015,346 | A | 1/2000 | Bennett |
| 6,027,115 | A | 2/2000 | Griswold et al. |
| 6,050,895 | A | 4/2000 | Luciano, Jr. et al. |
| 6,054,969 | A | 4/2000 | Haisma |
| 6,056,642 | A | 5/2000 | Bennett |
| 6,057,814 | A | 5/2000 | Kalt |
| 6,059,289 | A | 5/2000 | Vancura |
| 6,059,658 | A | 5/2000 | Mangano et al. |
| 6,068,552 | A | 5/2000 | Walker et al. |
| 6,086,066 | A | 7/2000 | Takeuchi et al. |
| 6,089,977 | A | 7/2000 | Bennett |
| 6,089,978 | A | 7/2000 | Adams |
| 6,093,102 | A | 7/2000 | Bennett |
| 6,105,962 | A | 8/2000 | Malavazos et al. |
| 6,113,098 | A | 9/2000 | Adams |
| 6,135,884 | A | 10/2000 | Hedrick et al. |
| 6,142,873 | A | 11/2000 | Weiss et al. |
| 6,142,874 | A | 11/2000 | Kodachi et al. |
| 6,159,095 | A | 12/2000 | Frohm et al. |
| 6,159,098 | A | 12/2000 | Slomiany et al. |
| 6,162,121 | A | 12/2000 | Morro et al. |
| 6,164,645 | A | 12/2000 | Weiss |
| 6,168,520 | B1 | 1/2001 | Baerlocher et al. |
| 6,173,955 | B1 | 1/2001 | Perrie et al. |
| 6,174,234 | B1 | 1/2001 | Seibert et al. |
| 6,174,235 | B1 | 1/2001 | Walker et al. |
| 6,203,429 | B1 | 3/2001 | Demar et al. |
| D441,031 | S | 4/2001 | Seelig et al. |
| 6,213,875 | B1 | 4/2001 | Suzuki |
| 6,213,876 | B1 | 4/2001 | Moore, Jr. |
| 6,220,593 | B1 | 4/2001 | Pierce et al. |
| 6,224,483 | B1 | 5/2001 | Mayeroff |
| 6,227,970 | B1 | 5/2001 | Shimizu et al. |
| 6,227,971 | B1 | 5/2001 | Weiss |
| D443,313 | S | 6/2001 | Brettschneider |
| 6,244,596 | B1 | 6/2001 | Kondratjuk |
| 6,251,013 | B1 | 6/2001 | Bennett |
| 6,251,014 | B1 | 6/2001 | Stockdale et al. |
| 6,252,707 | B1 | 6/2001 | Kleinberger et al. |
| 6,254,481 | B1 | 7/2001 | Jaffe |
| 6,261,177 | B1 | 7/2001 | Bennett |
| 6,267,669 | B1 | 7/2001 | Luciano, Jr. et al. |
| 6,270,411 | B1 | 8/2001 | Gura et al. |
| 6,270,412 | B1 | 8/2001 | Crawford |
| 6,297,785 | B1 | 10/2001 | Sommer et al. |
| 6,302,790 | B1 | 10/2001 | Brossard |
| 6,305,686 | B1 | 10/2001 | Perrie et al. |
| 6,312,334 | B1 | 11/2001 | Yoseloff |
| 6,315,663 | B1 | 11/2001 | Sakamoto |
| 6,315,666 | B1 | 11/2001 | Mastera et al. |
| 6,322,445 | B1 | 11/2001 | Miller |
| 6,334,814 | B1 | 1/2002 | Adams |
| 6,336,863 | B1 | 1/2002 | Baerlocher et al. |
| 6,337,513 | B1 | 1/2002 | Clevenger et al. |
| 6,340,158 | B2 | 1/2002 | Pierce et al. |
| 6,347,996 | B1 | 2/2002 | Gilmore et al. |
| 6,368,216 | B1 | 4/2002 | Hedrick et al. |
| 6,379,244 | B1 | 4/2002 | Sagawa et al. |
| 6,386,974 | B1 | 5/2002 | Adams |
| 6,398,220 | B1 | 6/2002 | Inoue |
| 6,416,827 | B1 | 7/2002 | Chakrapani et al. |
| 6,419,579 | B1 | 7/2002 | Bennett et al. |
| 6,444,496 | B1 | 9/2002 | Edwards et al. |
| 6,445,185 | B1 | 9/2002 | Damadian et al. |
| 6,461,241 | B1 | 10/2002 | Webb et al. |
| D465,531 | S | 11/2002 | Luciano, Jr. et al. |
| 6,481,713 | B2 | 11/2002 | Perrie et al. |
| 6,491,583 | B1 | 12/2002 | Gauselmann |
| 6,503,147 | B1 | 1/2003 | Stockdale et al. |
| 6,511,375 | B1 | 1/2003 | Kaminkow |
| 6,512,559 | B1 | 1/2003 | Hashimoto et al. |
| 6,514,141 | B1 | 2/2003 | Kaminkow et al. |
| 6,517,432 | B1 | 2/2003 | Jaffe |
| 6,517,433 | B2 | 2/2003 | Loose et al. |
| 6,517,437 | B1 | 2/2003 | Wells et al. |
| 6,520,856 | B1 | 2/2003 | Walker et al. |
| 6,533,273 | B2 | 3/2003 | Cole et al. |
| 6,533,660 | B2 | 3/2003 | Seelig et al. |
| 6,537,152 | B2 | 3/2003 | Seelig et al. |
| 6,547,664 | B2 | 4/2003 | Sanders |
| 6,575,541 | B1 | 6/2003 | Hedrick et al. |
| 6,582,307 | B2 | 6/2003 | Webb |
| 6,585,591 | B1 | 7/2003 | Baerlocher et al. |
| 6,589,114 | B2 | 7/2003 | Rose |
| 6,605,000 | B2 | 8/2003 | Adams |
| 6,609,972 | B2 | 8/2003 | Seelig et al. |
| 6,612,574 | B1 | 9/2003 | Cole et al. |
| 6,612,575 | B1 | 9/2003 | Cole et al. |
| 6,612,927 | B1 | 9/2003 | Slomiany et al. |
| D480,961 | S | 10/2003 | Deadman |
| 6,638,167 | B1 | 10/2003 | Sawyer et al. |
| 6,644,664 | B2 | 11/2003 | Muir et al. |
| 6,646,695 | B1 | 11/2003 | Gauselmann |
| 6,652,378 | B2 | 11/2003 | Cannon et al. |

6,659,864 B2 12/2003 McGahn et al.
6,661,425 B1 12/2003 Hiroaki
6,663,488 B1 12/2003 Adams
6,663,489 B2 12/2003 Baerlocher
6,695,696 B1 2/2004 Kaminkow
6,695,703 B1 2/2004 McGahn
6,702,675 B2 3/2004 Poole et al.
6,712,694 B1 3/2004 Nordman
6,715,756 B2 4/2004 Inoue
6,717,728 B2 4/2004 Putilin
6,722,979 B2 4/2004 Gilmore et al.
6,726,204 B2 4/2004 Inoue
6,726,563 B1 4/2004 Baerlocher et al.
6,780,111 B2 8/2004 Cannon et al.
D496,968 S 10/2004 Baerlocher
6,802,777 B2 10/2004 Seelig et al.
6,817,945 B2 11/2004 Seelig et al.
6,817,946 B2 11/2004 Motegi et al.
6,827,646 B2 12/2004 Adams
D503,951 S 4/2005 Karstens
6,887,157 B2 5/2005 LeMay et al.
6,890,254 B2 5/2005 Kaminkow
6,890,259 B2 5/2005 Breckner et al.
6,906,762 B1 6/2005 Witehira et al.
6,908,381 B2 6/2005 Ellis
6,937,298 B2 8/2005 Okada
6,964,609 B2 11/2005 Haag et al.
6,981,635 B1 1/2006 Hughs-Baird et al.
7,011,581 B2 3/2006 Cole et al.
7,040,987 B2 5/2006 Walker et al.
7,056,215 B1 6/2006 Olive
7,066,814 B2 6/2006 Glavich et al.
7,095,180 B2 8/2006 Emslie et al.
7,097,560 B2 8/2006 Okada
7,108,603 B2 9/2006 Olive
7,115,033 B1 10/2006 Timperley
7,128,647 B2 10/2006 Muir
7,140,963 B2 11/2006 Kojima
7,144,321 B2 12/2006 Mayeroff
7,159,865 B2 1/2007 Okada
7,160,187 B2 1/2007 Loose et al.
7,166,029 B2 1/2007 Enzminger
7,169,048 B2 1/2007 Nozaki et al.
7,179,169 B2 2/2007 Beaulieu et al.
7,198,570 B2 4/2007 Rodgers et al.
7,204,753 B2 4/2007 Ozaki et al.
7,219,893 B2 5/2007 Tanimura et al.
7,220,181 B2 5/2007 Okada
7,223,172 B2 5/2007 Baerlocher et al.
7,226,358 B2 6/2007 Miller et al.
7,234,697 B2 6/2007 Okada
7,252,288 B2 8/2007 Seelig et al.
7,252,591 B2 8/2007 Van Asdale
7,255,643 B2 8/2007 Ozaki et al.
7,274,413 B1 9/2007 Sullivan et al.
7,281,980 B2 10/2007 Okada et al.
7,285,049 B1 10/2007 Luciano, Jr. et al.
7,306,520 B2 12/2007 Kaminkow et al.
7,309,284 B2 12/2007 Griswold et al.
7,311,598 B2 12/2007 Kaminkow et al.
7,311,604 B2 12/2007 Kaminkow et al.
7,322,884 B2 1/2008 Emori et al.
7,324,094 B2 1/2008 Moilanen et al.
7,329,181 B2 2/2008 Hoshino et al.
7,352,424 B2 4/2008 Searle
7,354,342 B2 4/2008 Paulsen et al.
7,355,660 B2 4/2008 Ikeda
7,390,259 B2 6/2008 Okada
7,399,226 B2 7/2008 Mishra
7,402,102 B2 7/2008 Marks et al.
7,404,766 B2 7/2008 Adachi et al.
7,439,683 B2 10/2008 Emslie et al.
7,458,890 B2 12/2008 Loose et al.
7,465,228 B2 12/2008 Okada
7,473,173 B2 1/2009 Peterson et al.
7,479,061 B2 1/2009 Okada
7,479,066 B2 1/2009 Emori
7,485,039 B2 2/2009 Okada
7,505,049 B2 3/2009 Engel
7,510,475 B2 3/2009 Loose et al.
7,510,476 B2 3/2009 Kobayashi
7,520,812 B2 4/2009 Okada
7,558,057 B1 7/2009 Naksen et al.
7,559,837 B1 7/2009 Yoseloff et al.
7,585,220 B2 9/2009 Loose et al.
7,594,852 B2 9/2009 Rasmussen
7,619,585 B2 11/2009 Bell et al.
7,624,339 B1 11/2009 Engel et al.
7,626,594 B1 12/2009 Witehira et al.
7,677,572 B2 3/2010 Ozaki et al.
7,695,364 B2 4/2010 Okada
7,710,391 B2 5/2010 Bell et al.
7,724,208 B1 5/2010 Engel et al.
7,730,413 B1 6/2010 Engel et al.
7,742,124 B2 6/2010 Bell
7,742,239 B2 6/2010 Bell et al.
7,778,877 B2 8/2010 Messer et al.
7,785,196 B2 8/2010 Baerlocher et al.
7,841,944 B2 11/2010 Wells
7,892,094 B2 2/2011 Tanimura et al.
7,972,206 B2 7/2011 Okada
8,002,625 B2 8/2011 Maya et al.
8,007,360 B2 8/2011 Kishi
8,016,669 B2 9/2011 Okada
8,096,867 B2 1/2012 Okada
8,142,273 B2 3/2012 Williams et al.
2001/0013681 A1 8/2001 Bruzzese et al.
2001/0016513 A1 8/2001 Muir et al.
2001/0024971 A1 9/2001 Brossard
2001/0031658 A1 10/2001 Ozaki et al.
2001/0054794 A1 12/2001 Cole et al.
2002/0022518 A1 2/2002 Okuda et al.
2002/0045472 A1 4/2002 Adams
2002/0086725 A1 7/2002 Fasbender et al.
2002/0094862 A1 7/2002 Inoue
2002/0119035 A1 8/2002 Hamilton
2002/0142829 A1 10/2002 Inoue
2002/0167637 A1 11/2002 Burke et al.
2002/0173354 A1 11/2002 Winans et al.
2002/0175466 A1 11/2002 Loose et al.
2002/0183105 A1 12/2002 Cannon et al.
2003/0026171 A1 2/2003 Brewer et al.
2003/0027624 A1 2/2003 Gilmore et al.
2003/0032478 A1 2/2003 Takahama et al.
2003/0032479 A1 2/2003 LeMay et al.
2003/0060271 A1 3/2003 Gilmore et al.
2003/0064781 A1 4/2003 Muir
2003/0069063 A1 4/2003 Bilyeu et al.
2003/0087690 A1 5/2003 Loose et al.
2003/0128427 A1 7/2003 Kalmanash et al.
2003/0130028 A1 7/2003 Aida et al.
2003/0157980 A1 8/2003 Loose et al.
2003/0176214 A1 9/2003 Burak et al.
2003/0199295 A1 10/2003 Vancura
2003/0220134 A1 11/2003 Walker et al.
2003/0232643 A1 12/2003 Inoue
2003/0234489 A1 12/2003 Okada
2003/0236114 A1 12/2003 Griswold et al.
2003/0236118 A1 12/2003 Okada
2004/0000754 A1 1/2004 Inoue
2004/0009803 A1 1/2004 Bennett et al.
2004/0012145 A1 1/2004 Inoue
2004/0014516 A1 1/2004 Inoue
2004/0014517 A1 1/2004 Inoue
2004/0017041 A1 1/2004 Inoue
2004/0018866 A1 1/2004 Inoue
2004/0023714 A1 2/2004 Asdale
2004/0026854 A1 2/2004 Inoue
2004/0029636 A1 2/2004 Wells
2004/0036218 A1 2/2004 Inoue
2004/0038726 A1 2/2004 Inoue
2004/0041340 A1 3/2004 Inoue
2004/0053660 A1 3/2004 Webb et al.
2004/0053665 A1 3/2004 Baerlocher
2004/0063490 A1 4/2004 Okada
2004/0066475 A1 4/2004 Searle
2004/0077401 A1 4/2004 Schlottmann
2004/0082373 A1 4/2004 Cole et al.

2004/0102244 A1 5/2004 Kryuchkov
2004/0102245 A1 5/2004 Escalera et al.
2004/0116178 A1 6/2004 Okada
2004/0142748 A1 7/2004 Loose et al.
2004/0147303 A1 7/2004 Imura et al.
2004/0150162 A1 8/2004 Okada
2004/0162146 A1 8/2004 Ooto
2004/0166925 A1 8/2004 Emori et al.
2004/0171423 A1 9/2004 Silva et al.
2004/0183251 A1 9/2004 Inoue
2004/0183972 A1 9/2004 Bell
2004/0192430 A1 9/2004 Burak et al.
2004/0192441 A1 9/2004 Nonaka
2004/0198485 A1 10/2004 Loose et al.
2004/0207154 A1 10/2004 Okada
2004/0209447 A1 10/2004 Gosain et al.
2004/0209666 A1 10/2004 Tashiro et al.
2004/0209667 A1 10/2004 Emori et al.
2004/0209668 A1 10/2004 Okada
2004/0209670 A1 10/2004 Adachi et al.
2004/0209671 A1 10/2004 Okada
2004/0209672 A1 10/2004 Okada
2004/0209678 A1 10/2004 Okada
2004/0209679 A1 10/2004 Nonaka
2004/0209683 A1 10/2004 Okada
2004/0214630 A1 10/2004 Mayeroff
2004/0214635 A1 10/2004 Okada
2004/0214636 A1 10/2004 Nonaka
2004/0214637 A1 10/2004 Nonaka
2004/0219967 A1 11/2004 Giobbi et al.
2004/0224747 A1 11/2004 Okada
2004/0224758 A1 11/2004 Okada et al.
2004/0229686 A1 11/2004 Tanimura et al.
2004/0233663 A1 11/2004 Emslie et al.
2004/0239582 A1 12/2004 Seymour
2004/0242323 A1 12/2004 Okada
2004/0256536 A1 12/2004 Su et al.
2004/0266515 A1 12/2004 Gauselmann
2004/0266536 A1 12/2004 Mattice et al.
2005/0012724 A1 1/2005 Kent
2005/0020348 A1 1/2005 Thomas et al.
2005/0020349 A1 1/2005 Tachikawa
2005/0026671 A1 2/2005 Baerlocher
2005/0026673 A1 2/2005 Paulsen et al.
2005/0032571 A1 2/2005 Asonuma
2005/0037843 A1 2/2005 Wells et al.
2005/0049032 A1 3/2005 Kobayashi
2005/0049046 A1 3/2005 Kobayashi
2005/0054424 A1 3/2005 Rothkranz et al.
2005/0059486 A1 3/2005 Kaminkow
2005/0062410 A1 3/2005 Bell et al.
2005/0063055 A1 3/2005 Engel
2005/0075159 A1 4/2005 Kaminkow et al.
2005/0079913 A1 4/2005 Inamura
2005/0085292 A1 4/2005 Inamura
2005/0096114 A1 5/2005 Cannon et al.
2005/0164786 A1 7/2005 Connelly
2005/0176493 A1 8/2005 Nozaki et al.
2005/0187003 A1 8/2005 Adachi et al.
2005/0192083 A1 9/2005 Iwamoto
2005/0192084 A1 9/2005 Iwamoto
2005/0192085 A1 9/2005 Iwamoto
2005/0192090 A1 9/2005 Muir et al.
2005/0206582 A1 9/2005 Bell et al.
2005/0208994 A1 9/2005 Berman
2005/0233799 A1 10/2005 LeMay et al.
2005/0239539 A1 10/2005 Inamura
2005/0245302 A1 11/2005 Bathiche et al.
2005/0253775 A1 11/2005 Stewart
2005/0255908 A1 11/2005 Wells
2005/0266912 A1 12/2005 Sekiguchi
2005/0272500 A1 12/2005 Tanimura et al.
2005/0282616 A1 12/2005 Tanimura et al.
2005/0282617 A1 12/2005 Sekiguchi et al.
2005/0285337 A1 12/2005 Durham et al.
2006/0025199 A1 2/2006 Harkins et al.
2006/0040721 A1 2/2006 Cuddy et al.
2006/0046822 A1 3/2006 Kaminkow et al.
2006/0058100 A1 3/2006 Pacey et al.
2006/0063580 A1 3/2006 Nguyen et al.
2006/0063584 A1 3/2006 Brill et al.
2006/0068875 A1 3/2006 Cregan et al.
2006/0073872 A1 4/2006 B-Jensen et al.
2006/0073873 A1 4/2006 Rodgers et al.
2006/0073881 A1 4/2006 Pryzby et al.
2006/0089192 A1 4/2006 Okada
2006/0100014 A1 5/2006 Griswold et al.
2006/0103951 A1 5/2006 Bell et al.
2006/0111179 A1 5/2006 Inamura
2006/0125745 A1 6/2006 Evanicky
2006/0125746 A1 6/2006 Sallese et al.
2006/0142077 A1 6/2006 Miles et al.
2006/0166727 A1 7/2006 Burak
2006/0191177 A1 8/2006 Engel
2006/0223627 A1 10/2006 Nozaki et al.
2006/0237905 A1 10/2006 Nicely et al.
2006/0281532 A1 12/2006 Yoshizawa
2006/0284574 A1 12/2006 Emslie et al.
2006/0290594 A1 12/2006 Engel et al.
2007/0004510 A1 1/2007 Underdahl et al.
2007/0004513 A1 1/2007 Wells
2007/0010315 A1 1/2007 Hein
2007/0021180 A1 1/2007 Osawa
2007/0026932 A1 2/2007 Sato
2007/0060249 A1 3/2007 Gomez et al.
2007/0060296 A1 3/2007 Yoshizawa
2007/0066383 A1 3/2007 Mori et al.
2007/0066389 A1 3/2007 Kojima
2007/0072665 A1 3/2007 Muir
2007/0077986 A1 4/2007 Loose et al.
2007/0105610 A1 5/2007 Anderson
2007/0120320 A1 5/2007 Miltenberger et al.
2007/0123330 A1 5/2007 Hishinuma et al.
2007/0123332 A1 5/2007 Hishinuma et al.
2007/0123348 A1 5/2007 Nozaki
2007/0123349 A1 5/2007 Hishinuma et al.
2007/0135203 A1 6/2007 Nicely
2007/0135204 A1 6/2007 Nicely
2007/0158904 A1 7/2007 Okada
2007/0184893 A1 8/2007 Fujimoto
2007/0202948 A1 8/2007 Muir et al.
2007/0206713 A1 9/2007 Yamaguchi
2007/0207851 A1 9/2007 Yoshizawa
2007/0218982 A1 9/2007 Baerlocher
2007/0228651 A1 10/2007 Loose et al.
2007/0252804 A1 11/2007 Engel et al.
2007/0257891 A1 11/2007 Esenther et al.
2008/0004104 A1 1/2008 Durham et al.
2008/0007486 A1 1/2008 Fujinawa et al.
2008/0020820 A1 1/2008 Iwamoto
2008/0020839 A1 1/2008 Wells et al.
2008/0020840 A1 1/2008 Wells et al.
2008/0020841 A1 1/2008 Wells et al.
2008/0064497 A1 3/2008 Griswold et al.
2008/0096655 A1 4/2008 Rasmussen et al.
2008/0113745 A1 5/2008 Williams et al.
2008/0113746 A1 5/2008 Williams et al.
2008/0113747 A1 5/2008 Williams et al.
2008/0113748 A1 5/2008 Williams et al.
2008/0113749 A1 5/2008 Williams et al.
2008/0113755 A1 5/2008 Rasmussen et al.
2008/0113756 A1 5/2008 Williams et al.
2008/0113775 A1 5/2008 Williams et al.
2008/0125210 A1 5/2008 Iwamoto
2008/0125219 A1* 5/2008 Williams et al. ..... 463/31
2008/0136741 A1* 6/2008 Williams et al. ..... 345/3.3
2008/0152842 A1 6/2008 Searle
2008/0153573 A1 6/2008 Okada
2008/0153574 A1 6/2008 Yoshizawa
2008/0153575 A1 6/2008 Okada
2008/0161087 A1 7/2008 Okada
2008/0161093 A1 7/2008 Okada
2008/0165132 A1 7/2008 Weiss et al.
2008/0167913 A1 7/2008 Wiswell et al.
2008/0176653 A1 7/2008 Kishi
2008/0182652 A1 7/2008 Rasmussen et al.
2008/0188283 A1 8/2008 Okada
2008/0214277 A1 9/2008 Kishi

| | | | | |
|---|---|---|---|---|
| 2008/0280673 | A1 | 11/2008 | Marks et al. | |
| 2008/0284792 | A1 | 11/2008 | Bell et al. | |
| 2008/0311977 | A1 | 12/2008 | Okada | |
| 2009/0006292 | A1 | 1/2009 | Block | |
| 2009/0036208 | A1* | 2/2009 | Pennington et al. | 463/33 |
| 2009/0061983 | A1 | 3/2009 | Kaufman | |
| 2009/0061984 | A1 | 3/2009 | Yi | |
| 2009/0069066 | A1 | 3/2009 | Yoshizawa | |
| 2009/0070709 | A1 | 3/2009 | Engel | |
| 2009/0075718 | A1 | 3/2009 | Yoshizawa | |
| 2009/0079667 | A1 | 3/2009 | Schlottmann et al. | |
| 2009/0082083 | A1 | 3/2009 | Wilson et al. | |
| 2009/0104954 | A1* | 4/2009 | Weber et al. | 463/1 |
| 2009/0104969 | A1 | 4/2009 | Paulsen et al. | |
| 2009/0104989 | A1 | 4/2009 | Williams et al. | |
| 2009/0111559 | A1 | 4/2009 | Souza et al. | |
| 2009/0111577 | A1 | 4/2009 | Mead | |
| 2009/0117977 | A1 | 5/2009 | Gelber et al. | |
| 2009/0131145 | A1 | 5/2009 | Aoki et al. | |
| 2009/0131148 | A1 | 5/2009 | Loose et al. | |
| 2009/0137306 | A1 | 5/2009 | Yoshizawa | |
| 2009/0143141 | A1 | 6/2009 | Wells et al. | |
| 2009/0181758 | A1 | 7/2009 | Loose et al. | |
| 2009/0191946 | A1 | 7/2009 | Thomas et al. | |
| 2009/0203420 | A1 | 8/2009 | Yoshizawa | |
| 2009/0247276 | A1 | 10/2009 | Okada | |
| 2009/0253498 | A1 | 10/2009 | Wolf et al. | |
| 2009/0286589 | A1 | 11/2009 | Rasmussen | |
| 2009/0325686 | A1 | 12/2009 | Davis et al. | |
| 2010/0045601 | A1 | 2/2010 | Engel et al. | |
| 2010/0081502 | A1 | 4/2010 | Rasmussen et al. | |
| 2010/0093426 | A1 | 4/2010 | Ozaki et al. | |
| 2010/0113122 | A1 | 5/2010 | Walker et al. | |
| 2010/0115391 | A1 | 5/2010 | Engel et al. | |
| 2010/0115439 | A1 | 5/2010 | Engel et al. | |
| 2010/0120499 | A1 | 5/2010 | Cohen | |
| 2010/0124968 | A1 | 5/2010 | Hoffman et al. | |
| 2010/0130280 | A1 | 5/2010 | Arezina et al. | |
| 2010/0156922 | A1 | 6/2010 | Bell et al. | |
| 2010/0201623 | A1 | 8/2010 | Engel et al. | |
| 2010/0248577 | A1 | 9/2010 | Bell et al. | |
| 2010/0285864 | A1 | 11/2010 | Baerlocher et al. | |
| 2010/0289819 | A1 | 11/2010 | Singh et al. | |
| 2011/0003627 | A1 | 1/2011 | Nicely et al. | |
| 2011/0007089 | A1 | 1/2011 | Bell et al. | |
| 2011/0117987 | A1 | 5/2011 | Aoki et al. | |
| 2011/0117989 | A1 | 5/2011 | Kennedy et al. | |
| 2011/0124411 | A1 | 5/2011 | Tanimura et al. | |
| 2011/0201404 | A1* | 8/2011 | Wells | 463/20 |
| 2011/0249026 | A1 | 10/2011 | Singh | |
| 2011/0285609 | A1 | 11/2011 | Engel | |
| 2011/0310121 | A1 | 12/2011 | Baron | |

FOREIGN PATENT DOCUMENTS

| | | |
|---|---|---|
| DE | 3105266 | 9/1982 |
| EP | 0 454 423 | 10/1991 |
| EP | 0 484 103 | 5/1992 |
| EP | 0 860 807 | 8/1998 |
| EP | 0 919 965 | 6/1999 |
| EP | 0 997 857 | 5/2000 |
| EP | 1 003 138 | 5/2000 |
| EP | 1 260 928 | 11/2002 |
| EP | 1 391 847 | 2/2004 |
| EP | 1 462 152 | 9/2004 |
| EP | 1 492 063 | 12/2004 |
| EP | 1 826 739 | 8/2007 |
| GB | 912685 | 12/1962 |
| GB | 1 464 896 | 2/1977 |
| GB | 2 120 506 | 11/1983 |
| GB | 2 201 821 | 9/1988 |
| GB | 2 253 300 | 9/1992 |
| GB | 2 316 214 | 2/1998 |
| JP | 64/054476 | 4/1989 |
| JP | 02/019182 | 1/1990 |
| JP | 04/220276 | 8/1992 |
| JP | 05/123438 | 5/1993 |
| JP | 05/123439 | 5/1993 |
| JP | 06/043425 | 2/1994 |
| JP | 06/142278 | 5/1994 |
| JP | 07/124290 | 5/1995 |
| JP | 08/173591 | 7/1996 |
| JP | 11/099240 | 4/1999 |
| JP | 11/137774 | 5/1999 |
| JP | 11/153970 | 6/1999 |
| JP | 11/244451 | 9/1999 |
| JP | 2000/011725 | 1/2000 |
| JP | 2000/267604 | 9/2000 |
| JP | 2000/300729 | 10/2000 |
| JP | 2000/350805 | 12/2000 |
| JP | 2001/062032 | 3/2001 |
| JP | 2001/161950 | 6/2001 |
| JP | 2001/190760 | 7/2001 |
| JP | 2001/238995 | 9/2001 |
| JP | 2001/252393 | 9/2001 |
| JP | 2001/252394 | 9/2001 |
| JP | 2001/305246 | 10/2001 |
| JP | 2001/327650 | 11/2001 |
| JP | 2002/017950 | 1/2002 |
| JP | 2002/078847 | 3/2002 |
| JP | 2002/085624 | 3/2002 |
| JP | 2002/113150 | 4/2002 |
| JP | 2004/089707 | 3/2004 |
| JP | 2004/105616 | 4/2004 |
| JP | 2004/166879 | 6/2004 |
| JP | 2005/253561 | 9/2005 |
| JP | 2005/266387 | 9/2005 |
| JP | 2005/274906 | 10/2005 |
| JP | 2005/274907 | 10/2005 |
| JP | 2005/283864 | 10/2005 |
| JP | 2006/059607 | 3/2006 |
| JP | 2006/346226 | 12/2006 |
| WO | WO 93/13446 | 7/1993 |
| WO | WO 99/42889 | 8/1999 |
| WO | WO 99/44095 | 9/1999 |
| WO | WO 99/53454 | 10/1999 |
| WO | WO 00/32286 | 6/2000 |
| WO | WO 01/09664 | 2/2001 |
| WO | WO 01/15127 | 3/2001 |
| WO | WO 01/15128 | 3/2001 |
| WO | WO 01/15132 | 3/2001 |
| WO | WO 01/38926 | 5/2001 |
| WO | WO 01/55127 | 8/2001 |
| WO | WO 02/41046 | 5/2002 |
| WO | WO 02/084637 | 10/2002 |
| WO | WO 02/086610 | 10/2002 |
| WO | WO 02/089102 | 11/2002 |
| WO | WO 03/001486 | 1/2003 |
| WO | WO 03/023491 | 3/2003 |
| WO | WO 03/032058 | 4/2003 |
| WO | WO 03/039699 | 5/2003 |
| WO | WO 03/040820 | 5/2003 |
| WO | WO 03/079094 | 9/2003 |
| WO | WO 2004/008226 | 1/2004 |
| WO | WO 2004/023825 | 3/2004 |
| WO | WO 2004/025583 | 3/2004 |
| WO | WO 2004/036286 | 4/2004 |
| WO | WO 2004/102520 | 11/2004 |
| WO | WO 2004/001486 | 12/2004 |
| WO | WO 2004/001488 | 12/2004 |
| WO | WO 2004/002143 | 12/2004 |
| WO | WO 2006/034192 | 3/2006 |
| WO | WO 2006/036948 | 4/2006 |
| WO | WO 2006/038819 | 4/2006 |
| WO | WO 2006/112740 | 10/2006 |
| WO | WO 2006/124976 | 11/2006 |
| WO | WO 2007/011717 | 1/2007 |
| WO | WO 2007/040413 | 4/2007 |
| WO | WO 2007/053349 | 5/2007 |
| WO | WO 2008/011049 | 1/2008 |
| WO | WO 2008/028153 | 3/2008 |
| WO | WO 2008/048857 | 4/2008 |
| WO | WO 2008/061068 | 5/2008 |
| WO | WO 2008/063908 | 5/2008 |
| WO | WO 2008/063914 | 5/2008 |
| WO | WO 2008/063952 | 5/2008 |
| WO | WO 2008/063956 | 5/2008 |
| WO | WO 2008/063968 | 5/2008 |
| WO | WO 2008/063969 | 5/2008 |

| | | |
|---|---|---|
| WO | WO 2008/063971 | 5/2008 |
| WO | WO 2008/079543 | 7/2008 |
| WO | WO 2009/029720 | 3/2009 |
| WO | WO 2009/039245 | 3/2009 |
| WO | WO 2009/039295 | 3/2009 |
| WO | WO 2009/054861 | 4/2009 |
| WO | WO 2010/023537 | 3/2010 |
| WO | WO 2010/039411 | 4/2010 |

* cited by examiner

GAMING SYSTEM, GAMING DEVICE AND METHOD FOR PROVIDING MULTIPLE DISPLAY EVENT INDICATORS

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. These gaming machines generally require the player to place or make a wager and use at least one of the input devices to activate the primary or base game. In many of these gaming machines, the award is based on the player obtaining a winning symbol or symbol combination and based on the amount of the wager (e.g., the higher the wager, the higher the award). Symbols or symbol combinations which are less likely to occur usually provide higher awards.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers or video screens. Part of the enjoyment and excitement of playing certain gaming machines is the occurrence of the secondary or bonus game (even before the player knows how much the bonus award will be).

Certain known gaming machines display the primary game on a primary display device and any bonus or secondary games on a secondary display device. Typically, in such known gaming machines, the primary display device is traditionally positioned proximate the player while the player is sitting at the gaming machine. That is, the primary display device is generally positioned substantially at a seated player's eye level, while the secondary display device is traditionally positioned above the primary display device and above the player's eye level. Because the secondary display device is traditionally positioned above the player's eye level, any secondary or bonus games which utilizes both the primary display device and the secondary display device requires the player to frequently look up at the secondary display and back down to the primary display. For example, for a secondary game (displayed on a secondary display device) which utilizes one or more symbols generated on the reels (displayed on a primary display device), a player must frequently look up at the secondary display device to view the status of the secondary game and then back down to the primary display device to view the results of the symbols generated on the reels. Such frequent head movements can cause player's discomfort and otherwise reduce the player's level of excitement and entertainment in playing such gaming machines.

Accordingly, there is a continuing need to provide new and different gaming machines and gaming systems which efficiently display information to players regarding primary games displayed on primary display devices and secondary games displayed on secondary display devices. In other words, there is a continuing need to provide new and different gaming machines and gaming systems which reduce a player's discomfort (at frequently looking at multiple display devices) and increases the player's level of excitement and entertainment in playing gaming machines which utilize multiple display devices.

SUMMARY

In various embodiments, the gaming system, gaming device, and gaming method disclosed herein utilizes a single display device to display one or more event indicators which convey information to the player that is otherwise displayed by a plurality of display devices. Specifically, the gaming system disclosed herein employs one or more event indicators displayed on a primary display device (generally positioned substantially at a seated player's eye level) to indicate to the player information regarding the play of a secondary game displayed on a separate secondary display device (positioned above the primary display device and above the player's eye level). In one such embodiment, the gaming system employs a multiple level or multiple layered display device as the primary display device. Such a primary display device includes an exterior display device arranged outside of and relative to an interior display device such that a common line of sight passes through a portion of the exterior display device to a portion of the interior display device. In this embodiment, at least one level or layer of the primary display device displays the play of the primary game and at least one level or layer of the primary display device displays one or more event indicators which indicate information regarding the play of a secondary game displayed on a secondary display device. Such a configuration alleviates the player from having to frequently look up at the secondary display to determine information regarding the play of the secondary game and then look back down to the primary display to view the play of the primary game. Such a configuration thus reduces a player's discomfort (at frequently looking at multiple display devices) and increases the player's level of excitement and entertainment in playing gaming machines which utilize multiple display devices.

In one example embodiment utilizing event indicators, the multiple layer primary display device displays a plurality of video reels, a plurality of symbol display positions associated with the reels and zero, one or more event indicators at zero, one or more of the symbol display positions associated with the displayed reels. The secondary display device of this embodiment displays: (i) a plurality of secondary game positions which correspond to the symbol display positions associated with the reels, and (ii) zero, one or more secondary game symbols at zero, one or more of the secondary game positions. More specifically, (i) the interior display device of the primary display device is configured to display a plurality of video reels and a plurality of symbol display positions associated with the displayed reels, and (ii) the exterior display device of the primary display device is configured to display: (A) zero, one or more event indicators at zero, one or more of the symbol display positions associated with the displayed reels and (B) zero, one or more transparent portions. It should be appreciated that for each secondary game symbol displayed by the secondary display device, the primary display device (and specifically the exterior display device of the primary display device) displays an event indicator at the corresponding symbol display position associated with the displayed reels. That is, at least one of the layers of the primary display device corresponds to the secondary display device such that if the secondary display device displays a secondary game symbol, the corresponding layer of the primary display device displays an indication to the player, such as a specifically positioned event indicator, to inform the player about the content displayed by the secondary display device (without requiring the player to look at the secondary display device).

In operation of this example embodiment, the gaming system causes the reels to generate and display a plurality of symbols. In addition to providing the player any award associated with any generated winning symbol combination, the gaming system also determines, for each secondary game symbol displayed by the secondary display device, if a designated symbol is generated at a symbol display position associated with the reels which corresponds to a secondary game position of the secondary display device which displays a secondary game symbol. For example, if the secondary display device of the gaming system displays a secondary game symbol at the bottom left corner symbol display position of a secondary symbol display position matrix, the gaming system will determine if a designated symbol is generated at the symbol display position located on the bottom row of the leftmost reel displayed by the primary display device. In this embodiment, if the gaming system determines that a predetermined quantity of designated symbols are generated at symbol display positions associated with the reels which correspond to secondary game positions of the secondary display device which displays secondary game symbols, the gaming system triggers a bonus event, such as providing the player a bonus award (such as providing the player a quantity of credits) or enabling the player to participate in a bonus game to try and win a bonus award.

Accordingly, by utilizing at least one of the layers of a multiple layer display device to display information or data regarding a play of a secondary or bonus game being simultaneously or substantially simultaneously displayed on a separate display device, the present disclosure enables a player to remain updated about the play of the secondary game without having to frequently look up at a secondary display device and then back down to the primary display device. Such a configuration thus reduces a player's discomfort in playing a secondary game that concurrently utilizes a plurality of spaced apart display devices.

Additional features and advantages are described herein, and will be apparent from the following Detailed Description and the figures.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
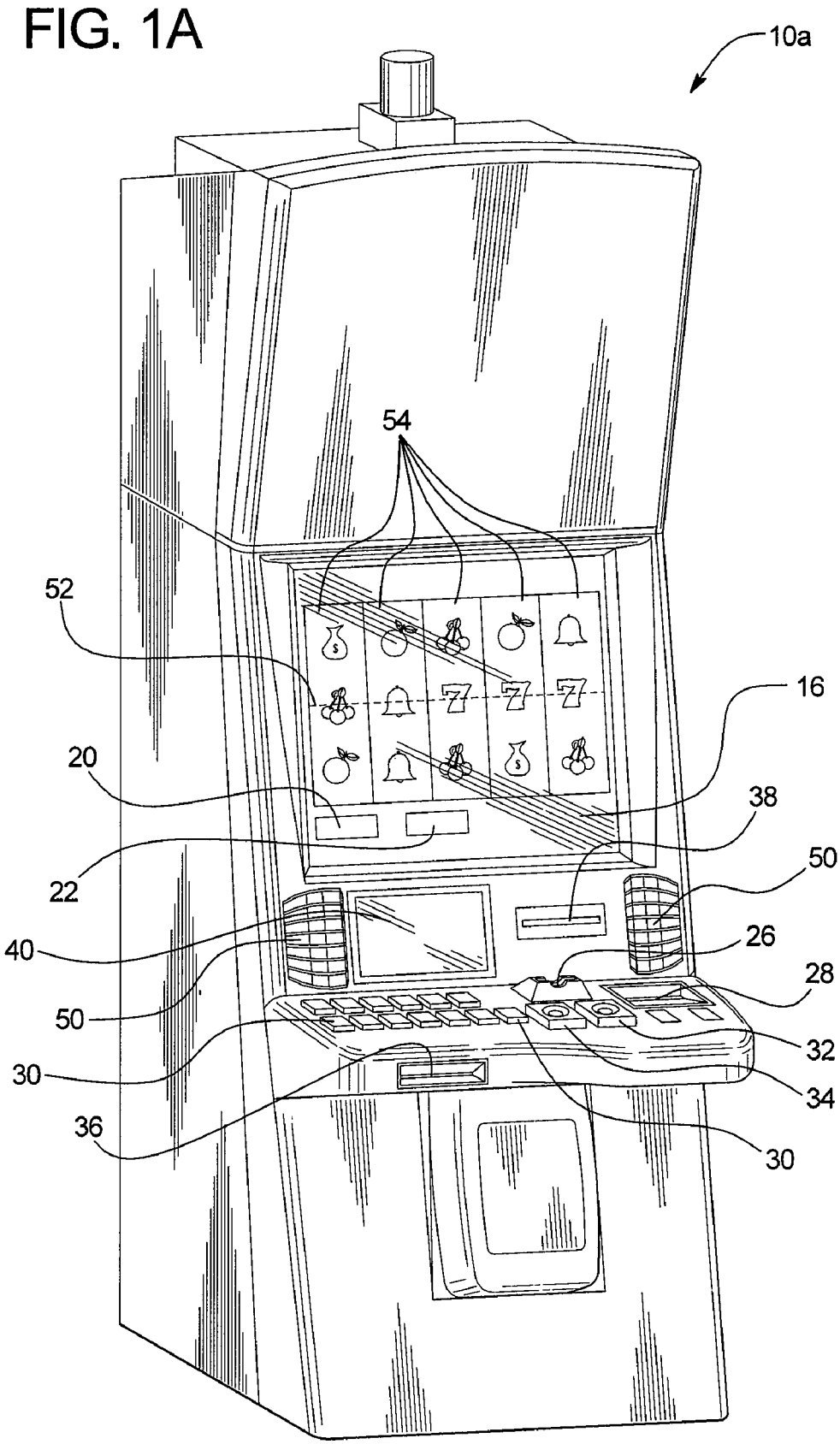
FIGS. 1A and 1B are front perspective views of alternative embodiments of gaming devices disclosed herein.
Figure 1B:
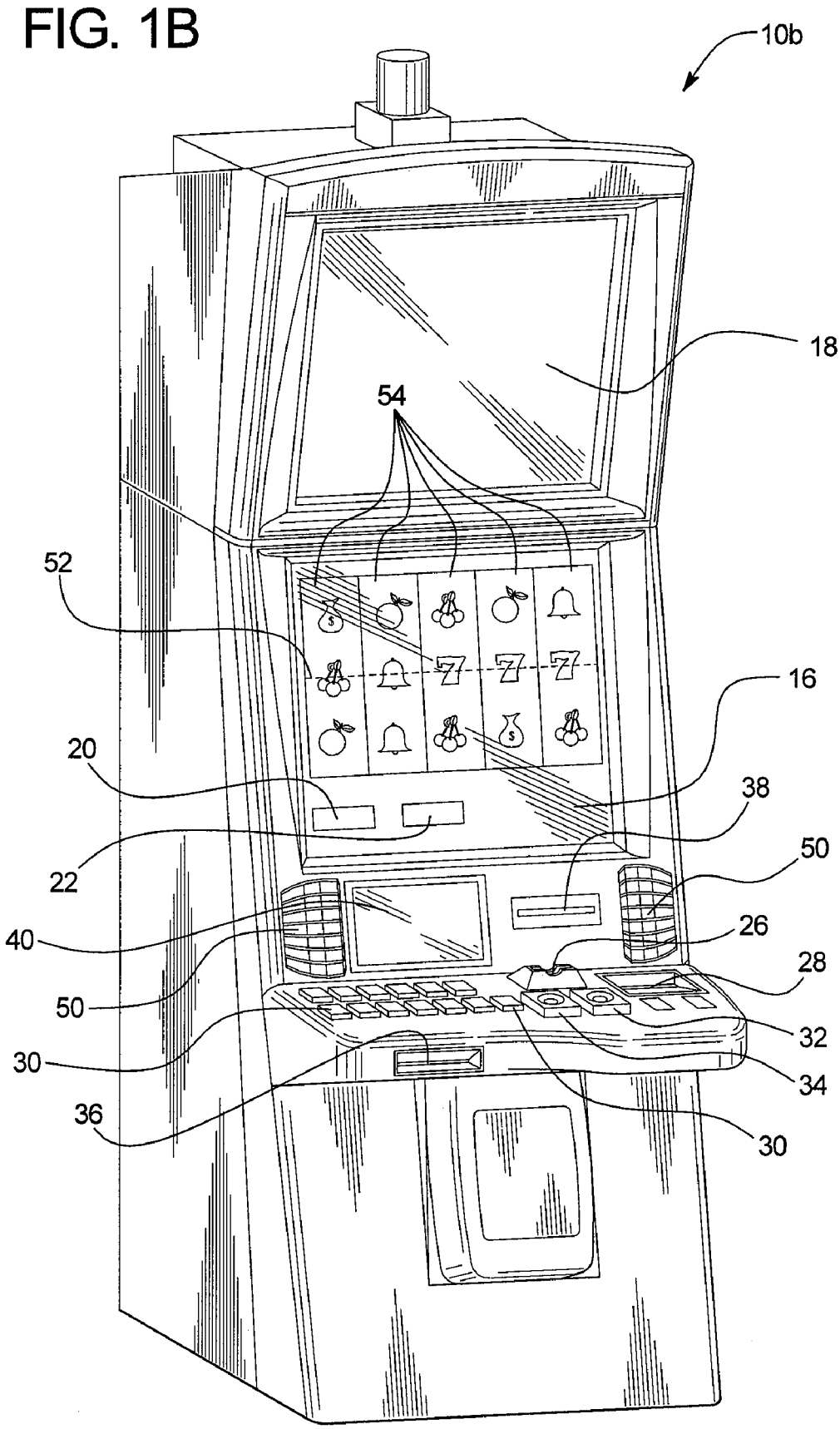

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
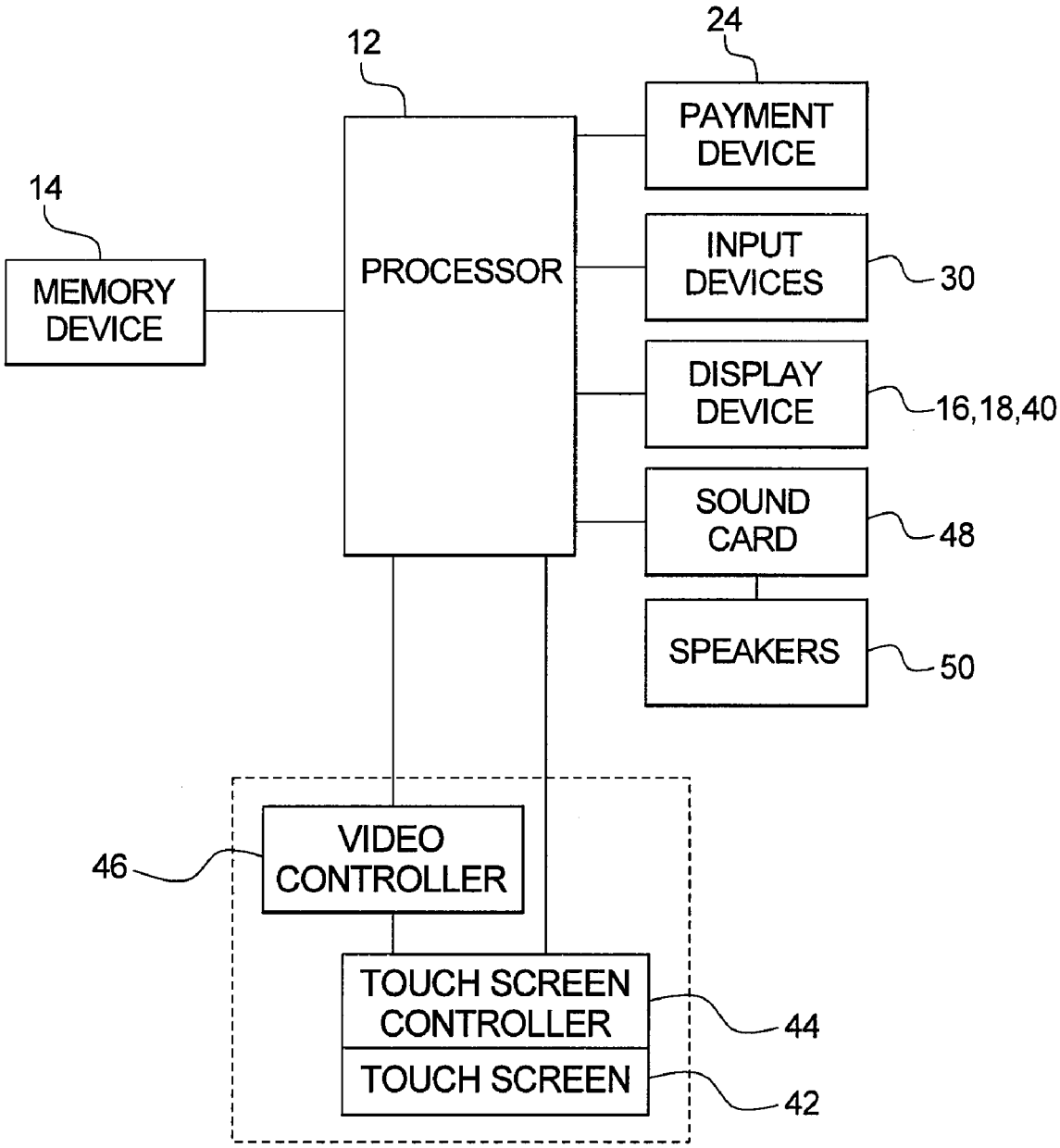
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central or primary display device 16 which displays a primary game. This display device may also display any suitable secondary game associated with the primary game as well as information relating to the primary or secondary game. The alternative embodiment shown in FIG. 1B includes a central or primary display device 16 and an upper or secondary display device 18. The upper display device may display any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as discussed in more detail below, the gaming device includes a player tracking display 40 which displays information regarding a player's play tracking status.

Figure 3:
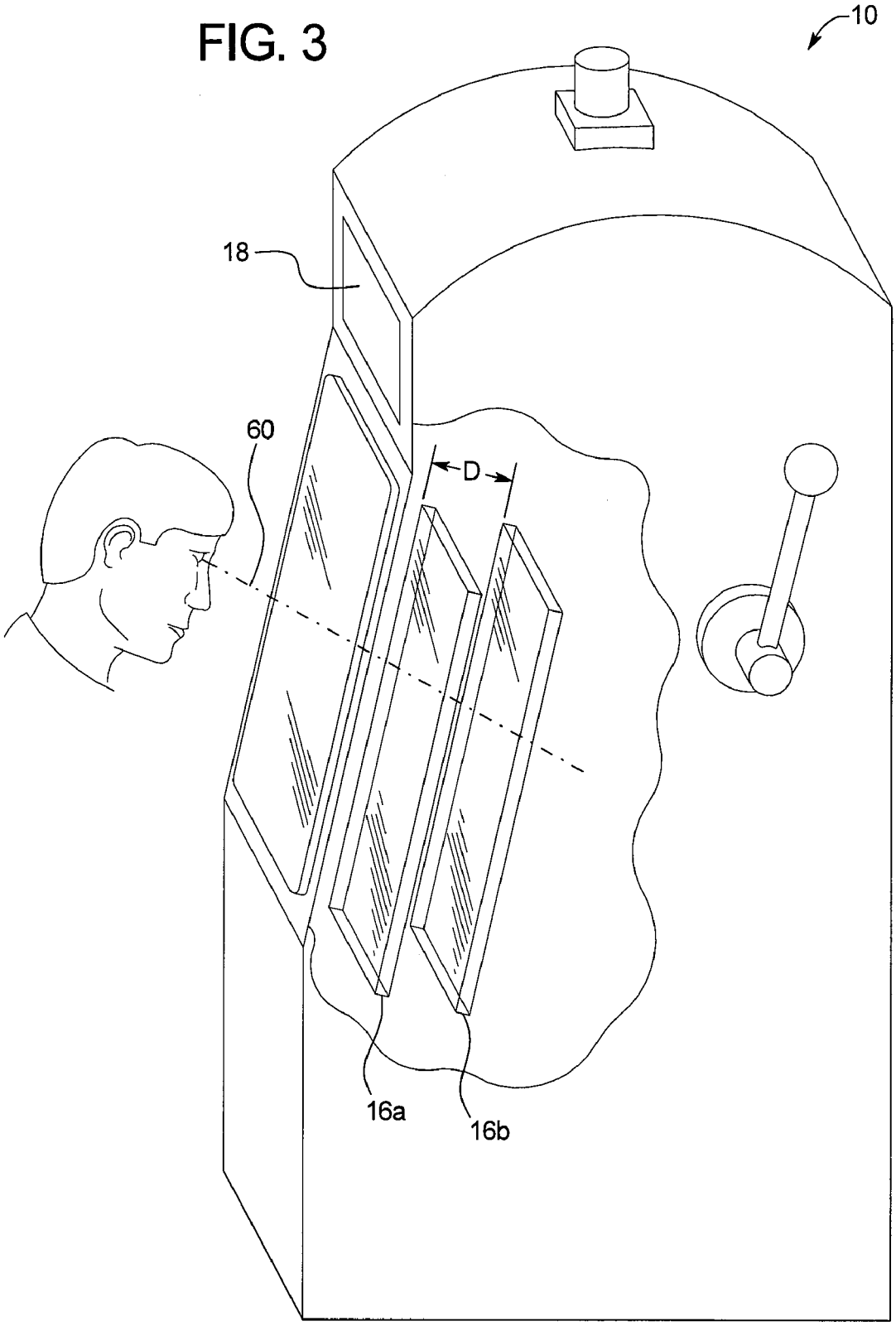
FIG. 3 is a side perspective view, partially in section, of one embodiment of the gaming system disclosed herein illustrating a plurality of layered display devices.

In one embodiment, as illustrated in FIG. 3, one or more of the display devices of the gaming device are multiple level or multiple layer display devices. In one such embodiment, the support structure, housing, or cabinet houses an exterior primary display device 16*a*, an interior primary display device 16*b* and a touchscreen. The exterior and interior primary display devices 16*a* and 16*b* are mounted and oriented within the housing such that at least one straight line of sight 60 intersects both of the faces or display surfaces of the exterior and interior primary display devices 16*a* and 16*b*. In this illustrated embodiment, the exterior and interior primary display devices are separated by a predetermined distance D which is the distance from the display surface of exterior primary display device 16*a* to the display surface of interior primary display device 16*b*. This distance can be any suitable predetermined distance desired by the gaming device manufacturer.

In one embodiment, the exterior primary display device 16*a* is translucent or transparent, or alternatively has the capacity to be translucent or transparent under the control of the processor. The interior primary display device 16*b* can be any suitable device adapted to display any appropriate images. In operation, when the exterior primary display device 16*a* is transparent or translucent, a player can see any images displayed on the exterior display device 16*a* as well as the images displayed on the interior primary display device 16*b* (i.e., by looking through the transparent exterior display device). Accordingly, the multiple layer display device can display co-acting or overlapping images to a player to enable a player to play a game or provide other game functions or game related functions. It should be appreciated that any suitable multiple level or multiple layer display device, such as any of the multiple layer display devices described in U.S. Pat. No. 7,841,944; U.S. Published Patent Application No. 2008/0113745; U.S. Published Patent Application No. 2008/0113746; U.S. Published Patent Application No. 2008/0113747; U.S. Published Patent Application No. 2008/0113748; U.S. Published Patent Application No. 2008/0113749; U.S. Published Patent Application No. 2008/0113775; U.S. Published Patent Application No. 2008/0125219; U.S. Published Patent Application No. 2008/0136741; U.S. Published Patent Application No. 2008/0113756; U.S. Published Patent Application No. 2009/0036208; and/or U.S. Published Patent Application No. 2009/0104969, may be employed as one or more of the multiple layer or multiple level display devices disclosed herein.

In another embodiment, at least one display device may be a mobile display device, such as a PDA or tablet PC, that enables play of at least a portion of the primary or secondary game at a location remote from the gaming device.

One or more of the display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as discussed in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as discussed above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in video form with simulated reels and movement thereof. Each reel includes a plurality of symbols positions. Each reel 54 displays a plurality of indicia or symbols, such as bells, hearts, fruits, numbers, letters, bars, or other images, at the plurality of symbols positions, which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as discussed above, the gaming device determines any outcome to provide to the player based on the number of associated symbols which are generated in active symbol display positions associated with the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol display positions on a first reel by the number of symbols generated in active symbol display positions on a second reel by the number of symbols generated in active symbol display positions on a third reel and so on for each reel of the gaming device with at least one symbol generated in an active symbol display position. For example, a three reel gaming device with three symbols generated in active symbol display positions on each reel includes 27 ways to win (i.e., 3 symbols on the first reel×3 symbols on the second reel×3 symbols on the third reel). A four reel gaming device with three symbols generated in active symbol display positions on each reel includes 81 ways to win (i.e., 3 symbols on the first reel×3 symbols on the second reel×3 symbols on the third reel×3 symbols on the fourth reel). A five reel gaming device with three symbols generated in active symbol display positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol display positions by one or more of the reels modifies the number of ways to win.

In another embodiment, the gaming device enables a player to wager on and thus activate symbol display positions. In one such embodiment, the symbol display positions are on the reels. In this embodiment, if based on the player's wager, a reel is activated, then each of the symbol display positions of that reel will be activated and each of the active symbol display positions will be part of one or more of the ways to win. In one embodiment, if based on the player's wager, a reel is not activated, then a designated number of default symbol display positions, such as a single symbol display position of the middle row of the reel, will be activated and the default symbol display position(s) will be part of one or more of the ways to win. This type of gaming machine enables a player to wager on one, more than one or all of the reels and the processor of the gaming device uses the number of wagered on reels to determine the active symbol display positions and the number of possible ways to win. In alternative embodiments, (1) no symbols are displayed as generated at any of the inactive symbol display positions, or (2) any symbols generated at any inactive symbol display positions may be displayed to the player but suitably shaded or otherwise designated as inactive.

In one embodiment wherein a player wagers on one or more reels, a player's wager of one credit may activate each of the three symbol display positions on a first reel, wherein one default symbol display position is activated on each of the remaining four reels. In this example, as discussed above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol display positions on a first reel, each of the three symbol display positions on a second reel and each of the three symbol display positions on a third reel wherein one default symbol display position is activated on each of the remaining two reels. In this example, as discussed above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol display position associated with a first reel forms part of a winning symbol combination with or is otherwise suitably related to a symbol generated in an active symbol display position associated with a second reel. In this embodiment, the gaming device classifies each pair of symbols which form part of a winning symbol combination (i.e., each pair of related symbols) as a string of related symbols. For example, if active symbol display positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as discussed above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol display positions (i.e., as opposed to a quantity of awards being based on how many paylines that would have passed through each of the strings of related symbols in active symbol display positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
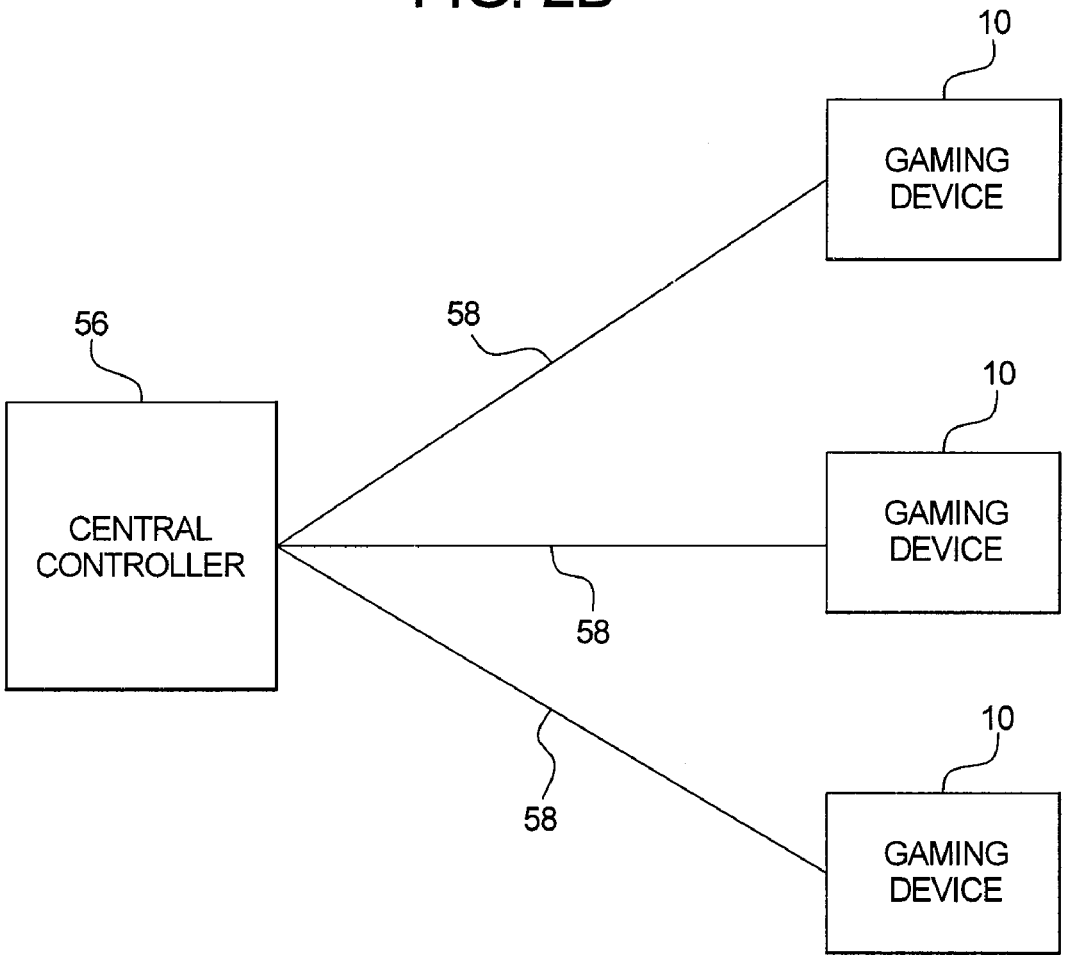
FIG. 2B is a schematic diagram of the central server in communication with a plurality of gaming devices in accordance with one embodiment of the gaming system disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As discussed above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as discussed above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as discussed above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as discussed above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as discussed above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Event Indicators

Figure 4:
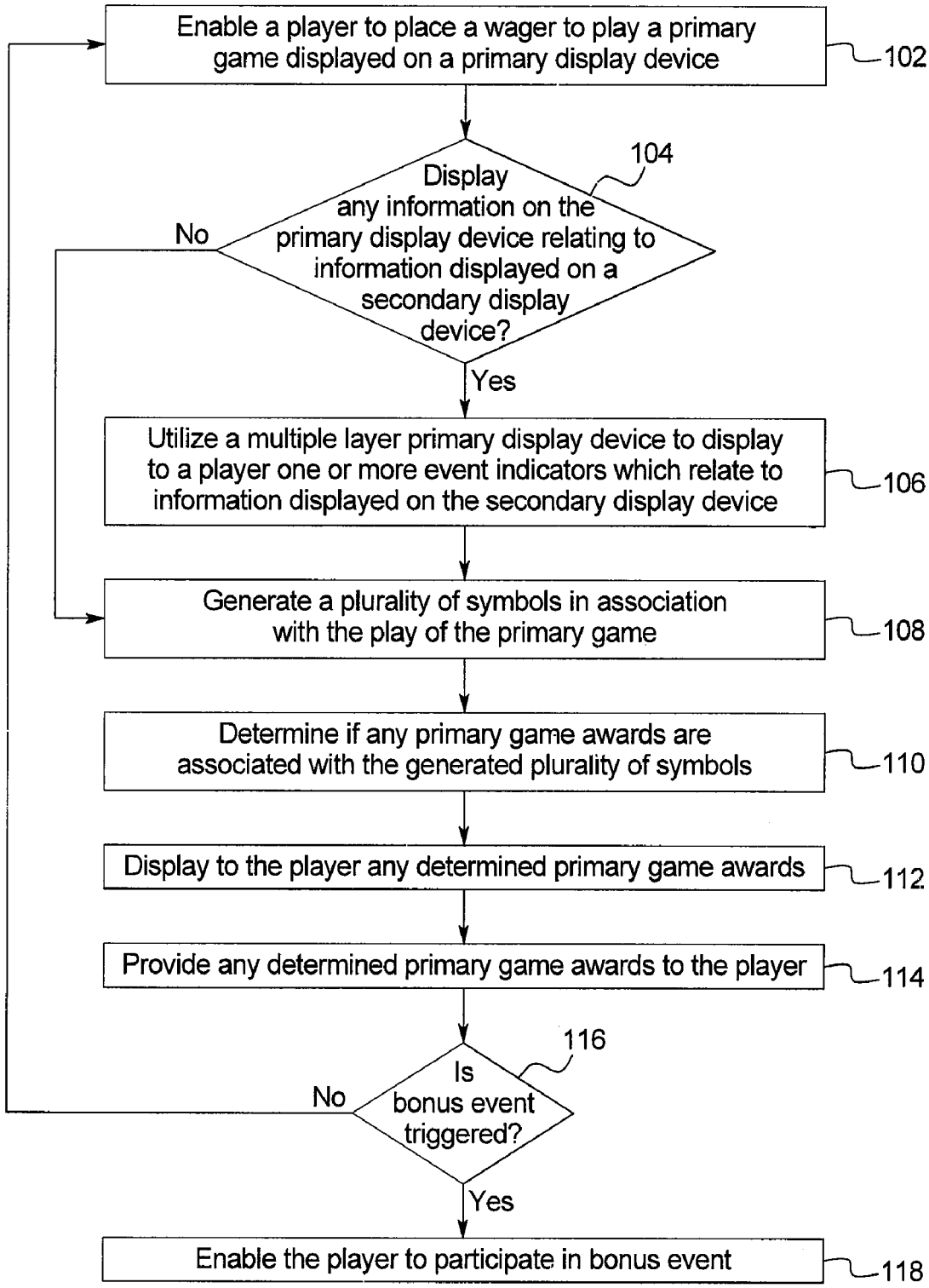
FIG. 4 is a flowchart of one embodiment of the gaming system disclosed herein illustrating the utilization of zero, one or more event indicators to display information to a player.

Referring now to FIG. 4, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 4, it should be appreciated that many other methods of performing the acts associated with this process may be used. For example, the order of certain steps described may be changed, or certain steps described may be optional.

In operation of this illustrated embodiment, as described above, the gaming system enables a player to place a wager to play a primary game displayed on a primary display device as indicated in block 102.

In association with the play of the primary game, the gaming system determines whether to display any information or data on the primary display device relating to or otherwise associated with information or data displayed on a secondary display device as indicated in diamond 104. In one such embodiment, the gaming device at least partially displays the secondary game over a plurality of different display devices and to increase convenience for the player, the gaming system determines whether to display any information associated with the secondary game at a central location, such as the primary display device.

If the determination is to display information or data on the primary display device relating to or otherwise associated with information or data displayed on the secondary display device, as indicated in block 106, the gaming system utilizes a multiple layer primary display device to display to a player one or more event indicators which relate to or are otherwise associated with such information or data displayed on the secondary display device. In one such embodiment, the gaming system utilizes a first layer of the multiple layer primary display device to display one or more components of the primary game and utilizes a second layer of the multiple layer primary display device to display one or more superimposed event indicators to convey information to the player regarding the content being displayed by a secondary display device. Such a configuration provides that the displayed event indicators do not interfere with the play of the primary game while also informing the player about what is displayed by other display devices of the gaming system.

After utilizing zero, one or more layers of the multiple layer primary display device to display zero, one or more event indicators to a player, the gaming system generates a plurality of symbols in association with the play of the primary game as indicated in block 108. In one such embodiment wherein the gaming system utilizes a first layer of the multiple layer primary display device to display one or more components of the primary game and utilizes a second layer of the multiple layer primary display device to display one or more superimposed event indicators, while the event indicators remain displayed by the second layer of the multiple layer primary display device, the gaming system causes the first layer of the multiple layer primary display device to display the plurality of generated symbols.

After generating a plurality of symbols for the play of the primary game, the gaming system determines if any primary game awards are associated with the generated plurality of symbols as indicated in block 110. The gaming system then displays and provides to the player any determined primary game awards as indicated in blocks 112 and 114.

In addition to providing any determined primary game awards associated with the generated plurality of symbols, the gaming system further determines whether any bonus event or bonus game is triggered as indicated in block 116. If the determination is that a bonus event is triggered, the gaming system enables the player to participate in the bonus event as indicated in block 118. On the other hand, if the determination is that no bonus event is triggered, the gaming system returns to block 102 and enables the player to place another wager for another play of the primary game displayed on the primary display device.

Figure 5A:
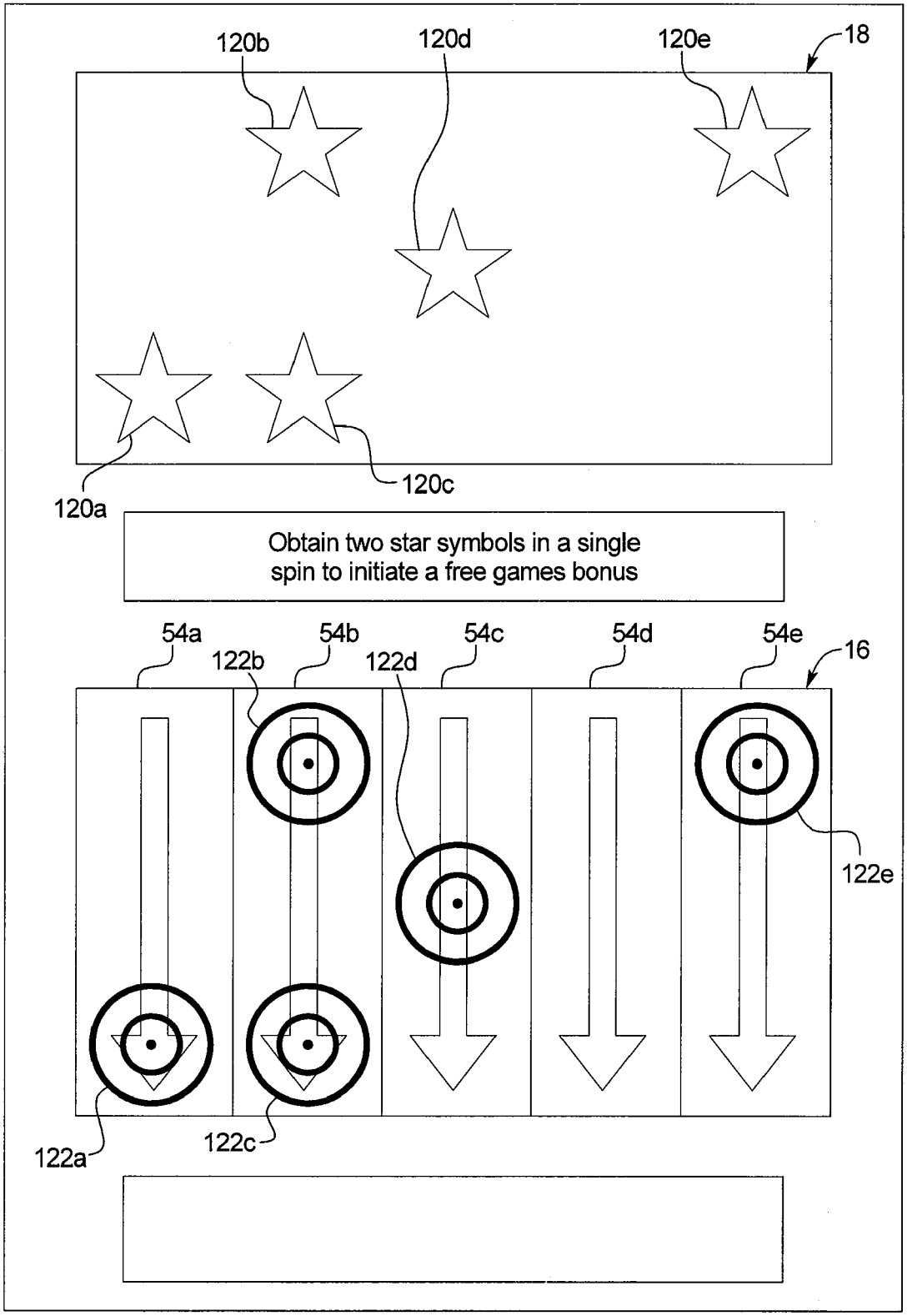
FIGS. 5A and 5B are front views of one embodiment of the gaming system disclosed herein illustrating the utilization of a plurality of event indicators to display information to a player regarding a play of a secondary game displayed by a secondary display device.

As illustrated in FIG. 5A, in one example embodiment of the gaming system disclosed herein, the gaming system causes the secondary display device 18 to display five secondary game symbols 120*a*, 120*b*, 120*c*, 120*d* and 120*e* at various secondary game symbol display positions. It should be appreciated that in different embodiments, the determination of how many, if any, secondary game symbols the secondary display device will be caused to display and/or the determination of which secondary game positions the secondary display device will display any secondary game symbols is predetermined, randomly determined, determined based on a player's status (such as determined through a player tracking system), determined based on a generated symbol or symbol combination, determined based on an amount coin-in, determined based on an amount coin-out, determined based on a predefined variable reaching a defined parameter threshold, determined based upon gaming system operator defined player eligibility parameters stored on a player tracking system (such as via a player tracking card or other suitable manner), determined based on a determination of if any numbers allotted to a gaming device match a randomly selected number, determined based on a random determination by the central controller, determined based on a random determination at the gaming device, determined based on one or more side wagers placed, determined based on the player's primary game wager, determined based on time (such as the time of day), determined independent of any displayed event in any play of any game of any of the gaming devices in the gaming system or determined based on any other suitable method or criteria.

After causing the secondary display device to display any secondary game symbols and prior to causing the primary display device 16 (and specifically the interior primary display device 16*a*) to display any symbols for the play of the primary game on reels 54*a*, 54*b*, 54*c*, 54*d* and 54*e*, the gaming system causes the primary display device 16 (and specifically the exterior primary display device 16*b*) to display event indicators, such as the displayed target symbols 122*a*, 122*b*, 122*c*, 122*d* and 122*e*, at the symbol display positions associated with the reels which correspond to the secondary game symbol display positions of the secondary display which display such secondary game symbols. As seen in FIG. 5A, since the target symbols are displayed by the exterior primary display device and the reels are displayed by the interior primary display device, the target symbols appear to the player as superimposed over the reels. In this example, the gaming system displays appropriate messages such as "OBTAIN TWO STAR SYMBOLS IN A SINGLE SPIN TO INITIATE A FREE GAMES BONUS" to the player visually, or through suitable audio or audiovisual displays. It should be appreciated that by displaying the secondary game symbols as event indicators on the primary display device, the gaming system disclosed herein provides a convenient and efficient way to display information from a plurality of different display devices on a single display device. Such a configuration limits the frequency by which players must look to different display devices during the play of a game and thus minimizes any discomfort caused by frequent head movements.

Figure 5B:
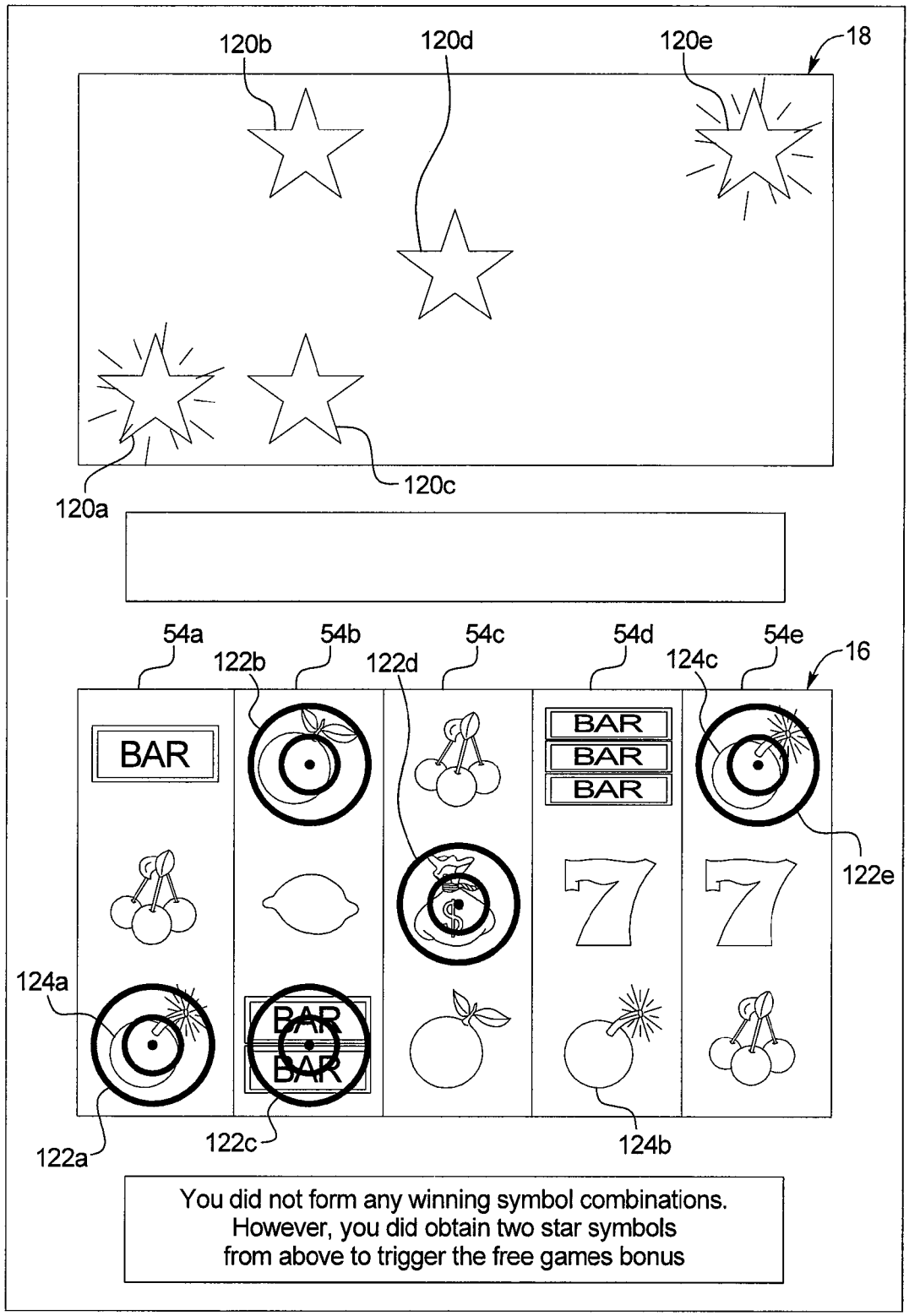

As seen in FIG. 5B, when the reels stop spinning, the gaming system determines that none of the generated symbols formed any winning symbol combinations and thus no primary game award is provided to the player. In this example, the gaming system displays appropriate messages such as "YOU DID NOT FORM ANY WINNING SYMBOL COMBINATIONS" to the player visually, or through suitable audio or audiovisual displays.

In addition to determining any winning symbol combinations, the gaming system determines whether any of the symbols generated by the reels are designated symbols (i.e., bomb symbols 124) generated at any symbol display positions which correspond to the positions of the secondary game symbols of the secondary display device. In this example, the designated bomb symbols 124*a* and 124*e* are generated at the corresponding positions of secondary game symbols 120*a* and 120*e*, respectively (indicated by target symbols 122*a* and 122*e*, respectively) and thus a bonus event is triggered. In this example, the gaming system displays appropriate messages such as "HOWEVER, YOU DID OBTAIN TWO STAR SYMBOLS FROM ABOVE TO TRIGGER THE FREE GAMES BONUS" to the player visually, or through suitable audio or audiovisual displays. It should be appreciated that rather than having to look up at the secondary display device to determine the corresponding positions which the secondary game symbols are generated on the secondary display device, the event indicators 122 previously displayed by the exterior primary display device 16*b* convey the same information to the player.

In another embodiment, one or more event indicators are employed in associated with the secondary display device to convey information associated with the primary display device. In another embodiment, the content displayed on the primary display device and the secondary display device is switched during a play of a game. In this embodiment, any event indicators currently employed with either the primary display device or the secondary display device are also switched such that the information that these event indicators convey remains consistent.

It should be appreciated that the type of event indicator displayed by the primary display device and/or the location on the primary display device where one or more event indicators are displayed may convey information to a player regarding the content being displayed on the secondary display device. It should be further appreciated that, in different embodiments, the event indicators display information related to or otherwise associated with content or features displayed on one or more secondary display devices including, but are not limited to:

a. a location of one or more symbols generated for a secondary game;
b. an applicable multiplier for a secondary game;
c. a quantity of modifier symbols for a secondary game;
d. a starting credit amount for a secondary game;
e. a value associated with at least one of the symbols in a secondary game;
f. a value associated with at least one winning payline in a secondary game
g. a quantity of picks in a secondary game;
h. a quantity of selections in a secondary game;
i. a quantity of wild symbols in a secondary game;
j. a quantity of wild reels in a secondary game;
k. a quantity of retrigger symbols in a secondary game;
l. a quantity of terminators or termination symbols in a secondary game;
m. a quantity of anti-terminators in a secondary game;
n. a quantity of locking reels in a secondary game;
o. a quantity of locking symbol display positions in a secondary game;
p. a quantity of expanding symbols in a secondary game;
q. a quantity of award opportunities in a secondary game;
r. a quantity of progressive awards in a secondary game;
s. a range of available awards in a secondary game;
t. a maximum award in a secondary game;
u. a minimum award in a secondary game;
v. a minimum award for triggering a bonus event;
w. a maximum award for triggering a bonus event;
x. a range of awards associated with triggering a bonus event;
y. a randomly determined award for triggering a bonus event;
z. a predetermined award for triggering a bonus event;
aa. a quantity of active reels in a secondary game;
bb. a quantity of active paylines in a secondary game;
cc. a quantity of offers in a secondary game;
dd. a paytable will be utilized in a secondary game;
ee. an average expected award in a secondary game;
ff. a quantity of hands of playing cards in a secondary game;
gg. a quantity of free spins in a secondary game;
hh. a quantity of free activations in a secondary game;
ii. a quantity of rounds or levels in a secondary game;
jj. any secondary game feature disclosed herein; and
kk. any other suitable secondary game feature.

In an alternative embodiment, rather than utilizing a multiple level or multiple layer display device (such as the display device shown in FIG. 3), the gaming system utilizes one or more transmissive display devices including a video display device positioned in a player's line of sight and in front of a mechanical display device, such as a mechanical reel. In this alternative embodiment, the video display device is configured to selectively display transparent, translucent and opaque images, such as one or more of the event indicators described herein. It should be appreciated that any suitable transmissive display device, such as any of the transmissive display devices described in U.S. Pat. No. 6,517,433; U.S. Pat. No. 7,654,899; U.S. Published Patent Application No. 2009/0280888; U.S. Published Patent Application No. 2009/0312095; U.S. Published Patent Application No. 2009/0131150; U.S. Published Patent Application No. 2010/0029368; U.S. Published Patent Application No. 2009/0286589; U.S. Published Patent Application No. 2008/0113755; U.S. Published Patent Application No. 2009/0075721; and/or U.S. Published Patent Application No. 2009/0131145 may be employed as one or more of the display devices disclosed herein.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

a first display device supported by the housing;

a second display device supported by the housing, said second display device arranged relative to the first display device such that a common line of sight passes through a portion of the first display device to a portion of the second display device;

a third display device supported by the housing, said third display device spaced apart from the first display device and the second display device;

at least one input device supported by the housing;

at least one processor; and at least one memory device which stores a plurality of instructions, which when executed by the at least one processor, cause the at least one processor to operate with the first display device, the second display device, the third display device and the at least one input device to:

(a) cause the second display device to display a plurality of reels associated with a plurality of symbol display positions;

(b) enable a player to place a wager on a play of a primary game;

(c) cause the third display device to display at least one secondary game symbol at least one secondary game symbol display position, wherein each secondary game symbol display position is associated with one of the symbol display positions of the plurality of reels;

(d) after causing the third display device to display the at least one secondary game symbol at the at least one secondary game symbol display position, for each secondary game symbol displayed, cause the first display device to display at least one event indicator at the symbol display position associated with the reels associated with the secondary game symbol display position of the displayed secondary game symbol;

(e) generate a plurality of symbols at the plurality of symbol display positions associated with the reels;

(f) cause the second display device to display the generated plurality of symbols at the plurality of symbol display positions associated with the reels; and (g) if at least one symbol displayed by the second display device is a designated symbol and said designated symbol is displayed at the same symbol display position associated with the reels which the first display device displayed at least one event indicator, cause a secondary game award to be provided to the player.

2. The gaming system of claim 1, wherein the third display device is positioned above the first display device and the second display device.

3. The gaming system of claim 1, wherein when executed by the at least one processor, the plurality of instructions cause the at least one processor to cause the first display device to display at least one transparent portion.

4. The gaming system of claim 1, wherein when executed by the at least one processor, the plurality of instructions cause the at least one processor to cause the secondary game award to be provided to the player if a plurality of symbols displayed by the second display device are designated symbols and said designated symbols are displayed at the same symbol display positions associated with the reels which the third display device displayed a plurality of event indicators.

5. The gaming system of claim 1, wherein the secondary game award is a plurality of free activations of the reels.

6. The gaming system of claim 1, wherein the secondary game award is a monetary amount.

7. The gaming system of claim 1, wherein the at least one event indicator displayed by the first display device displays information associated with the secondary game such that the player is not required to look at a plurality of the spaced apart display devices to obtain information associated with said secondary game.

8. A gaming system comprising:

a housing;

a first display device supported by the housing;

a second display device supported by the housing, said second display device arranged relative to the first display device such that a common line of sight passes through a portion of the first display device to a portion of the second display device;

a third display device supported by the housing, said third display device spaced apart from the first display device and the second display device;

at least one input device supported by the housing;

at least one processor; and at least one memory device which stores a plurality of instructions, which when executed by the at least one processor, cause the at least one processor to operate with the first display device, the second display device, the third display device and the at least one input device to:

(a) enable a player to place a wager on a play of a primary game;

(b) cause the third display device to display at least one component of a secondary game;

(d) after causing the third display device to display the at least one component of the secondary game, cause the first display device to display indicia associated with the at least one component of the secondary game;

(e) generate a plurality of symbols for the play of the primary game;

(f) cause the second display device to display the generated plurality of symbols; and (g) if at least one symbol displayed by the second display device is a designated symbol:

(i) cause the third display device to display said at least one designated symbol, and (ii) cause a secondary game award to be provided to the player.

9. The gaming system of claim 8, wherein the third display device is positioned above the first display device and the second display device.

10. The gaming system of claim 8, wherein when executed by the at least one processor, the plurality of instructions cause the at least one processor to cause the first display device to display at least one transparent portion.

11. The gaming system of claim 8, wherein when executed by the at least one processor, the plurality of instructions cause the at least one processor to cause the secondary game award to be displayed to the player if a plurality of symbols displayed by the second display device are designated symbols.

12. The gaming system of claim 8, wherein the secondary game award is a plurality of free activations of the primary game.

13. The gaming system of claim 8, wherein the secondary game award is a monetary amount.

* * * * *

UNITED STATES PATENT AND TRADEMARK OFFICE

CERTIFICATE OF CORRECTION

PATENT NO. : 8,298,081 B1
APPLICATION NO. : 13/162138
DATED : October 30, 2012
INVENTOR(S) : Brent Alan Merritt et al.

It is certified that error appears in the above-identified patent and that said Letters Patent is hereby corrected as shown below:

IN THE CLAIMS

In Claim 1, Column 24, Line 56, between "symbol" and "at" insert --at--.
In Claim 1, Column 25, Line 6, replace "symbol" with --of the symbols--.
In Claim 1, Column 25, Line 9, between "reels" and "which" insert --at--.
In Claim 1, Column 25, Line 10, between "displayed" and "at" insert --at--.
In Claim 4, Column 25, at about Line 21, between "of" and "symbols" insert --the--.
In Claim 4, Column 25, at about Line 24, between "reels" and "which" insert --at--.
In Claim 7, Column 25, Line 33, replace "the secondary" with --a secondary--.
In Claim 8, Column 26, Line 13, replace "(d)" with --(c)--.
In Claim 8, Column 26, Line 17, replace "(e)" with --(d)--.
In Claim 8, Column 26, Line 19, replace "(f)" with --(e)--.
In Claim 8, Column 26, Line 21, replace "(g)" with --(f)-- and replace "symbol" with --of the symbols--.
In Claim 11, Column 26, Line 37, replace "displayed" with --provided-- and between "of" and "symbols" insert --the--.

Signed and Sealed this
Twenty-third Day of July, 2013

Teresa Stanek Rea
*Acting Director of the United States Patent and Trademark Office*